US006575157B1

(12) United States Patent
Shaver

(10) Patent No.: US 6,575,157 B1
(45) Date of Patent: Jun. 10, 2003

(54) HEAT SHIELDING SYSTEM FOR DOWNDRAFT COOKTOP FAN

(75) Inventor: Michael J. Shaver, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/186,608

(22) Filed: Jul. 2, 2002

(51) Int. Cl.[7] ..... F24C 15/20

(52) U.S. Cl. ..... 126/299 D; 126/21 R; 126/201

(58) Field of Search ..... 126/299 R, 299 D, 126/21 R, 312, 201, 85 B, 307 R; 417/368, 78, 97, 98, 139; 415/180; 165/121, 122; 310/62, 63; 454/16

(56) References Cited

U.S. PATENT DOCUMENTS 1,332,474 A * 3/1920 Skelly ..... 126/201
2,188,741 A * 1/1940 Roberts ..... 454/16
4,750,470 A 6/1988 Beach et al.
4,757,802 A * 7/1988 Guzorek ..... 126/80
5,287,799 A 2/1994 Pickering et al.
5,301,653 A 4/1994 Gerdes et al.
5,375,651 A * 12/1994 Colwell ..... 417/368
5,742,031 A 4/1998 Kelly et al.
6,231,311 B1 * 5/2001 Gatley et al. ..... 417/53

* cited by examiner

*Primary Examiner*—James C. Yeung
(74) *Attorney, Agent, or Firm*—Diederiks & Whitelaw, PLC

(57) ABSTRACT

A heat shielding assembly, preferably for a downdraft cooking system including a fan motor mounted outside a plenum located below a cooktop for generating an air flow designed to remove air laden cooking byproducts from a cooking zone, prevents direct contact with laminations of the motor which become heated during use of the fan. The heat shielding assembly preferably takes the form of a plastic sleeve which encircles a housing portion of the motor. Therefore, the sleeve is designed to protect a consumer, maintenance personnel or the like from direct contact with motor housing portions which have become hot during operation of the downdraft system when an area below the cooktop is accessed.

17 Claims, 2 Drawing Sheets

HEAT SHIELDING SYSTEM FOR DOWNDRAFT COOKTOP FAN

BACKGROUND OF THE INVENTION

1. Field of the Invention

The present invention pertains to the art of cooking and, more particularly, to an arrangement for shielding an individual from direct contact with exposed, heated motor laminations of a fan motor preferably employed in connection with a downdraft cooktop.

2. Discussion of the Prior Art

Cooktops presently available in the marketplace are known to take various forms, incorporate a wide range of cooking surfaces, and utilize different heat sources including both gas and electric. Certain cooktop models are adapted to be directly mounted in a kitchen countertop or island. Often, such cooktops have associated therewith a downdraft feature wherein a fan is utilized to draw airborne cooking grease, odor and other byproducts through a surface grate into a plenum, direct the byproducts through an air filter and then expel the remaining, laden air from the kitchen to a specified outside location with the use of suitable ducting.

Typically, the air filter is arranged below the countertop surface upon which the cooktop is mounted in order to ease replacement thereof. Most often, the countertop is supported by cabinetry incorporating cabinet doors which enable access to an area below the cooktop where the plenum and filter are located. Although the downdraft fan can actually be located remote from the cooktop, the fan is most often also located directly below the cooktop. More particularly, the fan is encased within the plenum or another housing in order to protect a consumer from direct contact with the motor, as portions thereof can actually become quite hot when the downdraft system is activated for a significant period of time. In fact, there exist AGA/UL requirements that must be fully met in this regard in order to make a downdraft system commercially viable, at least in the United States.

Obviously, protecting the consumer is a paramount concern. However, encasing the downdraft fan in this manner is considered to have significant disadvantages. For instance, the overall encasement arrangement can be costly to both produce and assemble. That is, the housing must be designed for ease of access of the fan in case maintenance is required. However, the available space is limited. For these and other reasons, it is actually common to find that the overall housing is made up of a rather large number of parts. For instance, in one known prior art arrangement, the entire motor housing structure requires twenty (20) assembly pieces. In addition, encasing a fan motor in this manner can severely restrict heat dissipation. Certainly, considerations must be made to assure that these prior arrangements would not lead to an overheating problem.

With the above concerns in mind, it would be desirable to be able to minimize the number of assembly components associated with a downdraft system for a cooktop in order to reduce manufacturing costs. At the same time, there is a need to provide an efficient heat dissipating fan arrangement, while also incorporating sufficient heat shielding to protect a consumer from direct contact with fan motor laminations.

SUMMARY OF THE INVENTION

The present invention is directed to a heat shielding assembly for a vented cooking system. More specifically, a cooktop, arranged in a countertop, has associated therewith a downdraft venting system, including a fan for generating an air flow designed to remove air laden cooking byproducts from a cooking zone. In accordance with the invention, the fan is positioned so as to be accessible, such as from within cabinetry located directly below the cooktop, to a consumer and maintenance personnel. A motor of the fan is mounted outside of a plenum of an overall ducting arrangement for the downdraft system. In this sense, the motor is substantially, directly exposed upon opening of doors associated with the cabinetry. However, in order to prevent direct contact with laminations of the motor which will become heated during use, a shield, preferably in the form of a plastic sleeve, is provided to encircle a housing of the motor.

With this arrangement, the portions of the motor which can become excessively heated during operation of the fan are covered by the shield. Therefore, the shield will protect a consumer, maintenance personnel or the like from direct contact with motor housing portions which have become hot during operation of the downdraft system when an area below the cooktop is accessed. In any event, additional objects, features and advantages of the present invention will become more readily apparent from the following detailed description of a preferred embodiment, when taken in conjunction with the drawings wherein like reference numerals refer to corresponding parts in the several views.

DETAILED DESCRIPTION OF THE PREFERRED EMBODIMENT

Figure 1:
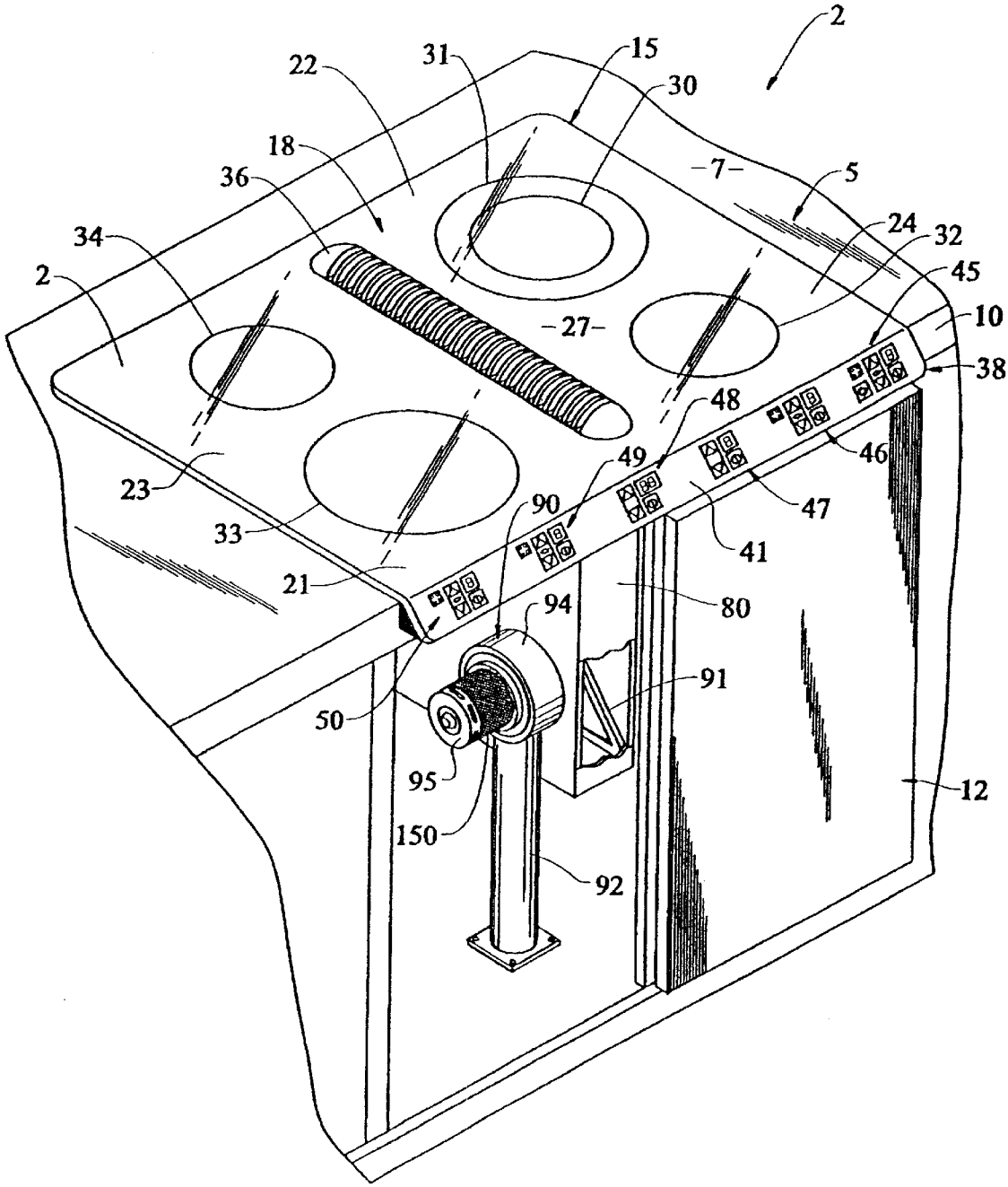
FIG. 1 is a perspective view of a cooktop with an exposed downdraft motor incorporating a protective heat shield in accordance with the invention.

With initial reference to FIG. 1, a kitchen cooking arrangement, generally indicated at 2, includes a countertop 5 having an upper surface 7 which extends in a generally horizontal plane and a front edge portion 10 which is depicted to be generally perpendicular to upper surface 7. Below countertop 5 is illustrated to be cabinetry 12. At this point, it should be noted that countertop 5 could be positioned against a wall within a kitchen or can form part of an island. Kitchen cooking arrangement 2 also incorporates a cooktop 15 that includes a main plate portion 18 which is secured upon upper surface 7 of countertop 5. Main plate portion 18 is generally defined by a frontal section 21, a rear section 22 and side edge sections 23 and 24. Main plate portion 18 has an upper surface 27 which defines various spaced heating element zones 30–34, with heating element zone 30 being concentrically arranged within heating element zone 31.

As shown, in the most preferred embodiment, upper surface 27 constitutes a smooth top-type cooking surface. More specifically, cooktop 15 is made from a ceramic-based material. By referring to cooktop 15 as being made from a ceramic-based material, it is intended to cover various materials including ceramic, glass-ceramic and like materials. Although cooktop 15 preferably includes a smooth cooking surface, heating element zones 30–34 could be defined by coiled resistance-type heating elements or even gas burners extending above or below upper surface 27. However, provided in accordance with the most preferred form of the invention is a downdraft venting arrangement including a grill 36 which, as shown, extends fore-to-aft from frontal section 21 to rear section 22 in a central portion of upper surface 27. As will become more fully evident below, the configuration and positioning of grill 36 can readily vary without departing from the invention.

Cooktop 15 also includes a face plate portion 38 that defines a heating element control panel. Face plate portion 38 includes an exposed surface 41 and is formed integral with main plate portion 18 such that the overall cooktop 15 defines a unitary, one-piece and integrally formed member. As clearly shown in these figures, face plate portion 38 extends downwardly and forwardly from main plate portion 18. In a preferred embodiment, cooktop 15 is positioned upon countertop 5 with face plate portion 38 projecting beyond front edge portion 10 and downwardly at an angle from main plate portion 18. With this arrangement, face plate portion 38 can be advantageously utilized as a control panel for the heating elements in zones 30–34. In the most preferred form of the invention, face plate portion 38 is formed with various openings (not separately labeled) which receive electronic control element arrays generally indicated at 45–50.

In general, the structure and operation of cooktop 15 is known in the art and has been presented here only for the sake of completeness in presenting an exemplary application of the present invention. More specifically, this known arrangement is disclosed in U.S. Pat. No. 6,297,482 which is incorporated herein by reference. To this end, the details and manner of utilizing electronic control element arrays 45–50 in connection with cooktop 15 will not be detailed further here.

Figure 2:
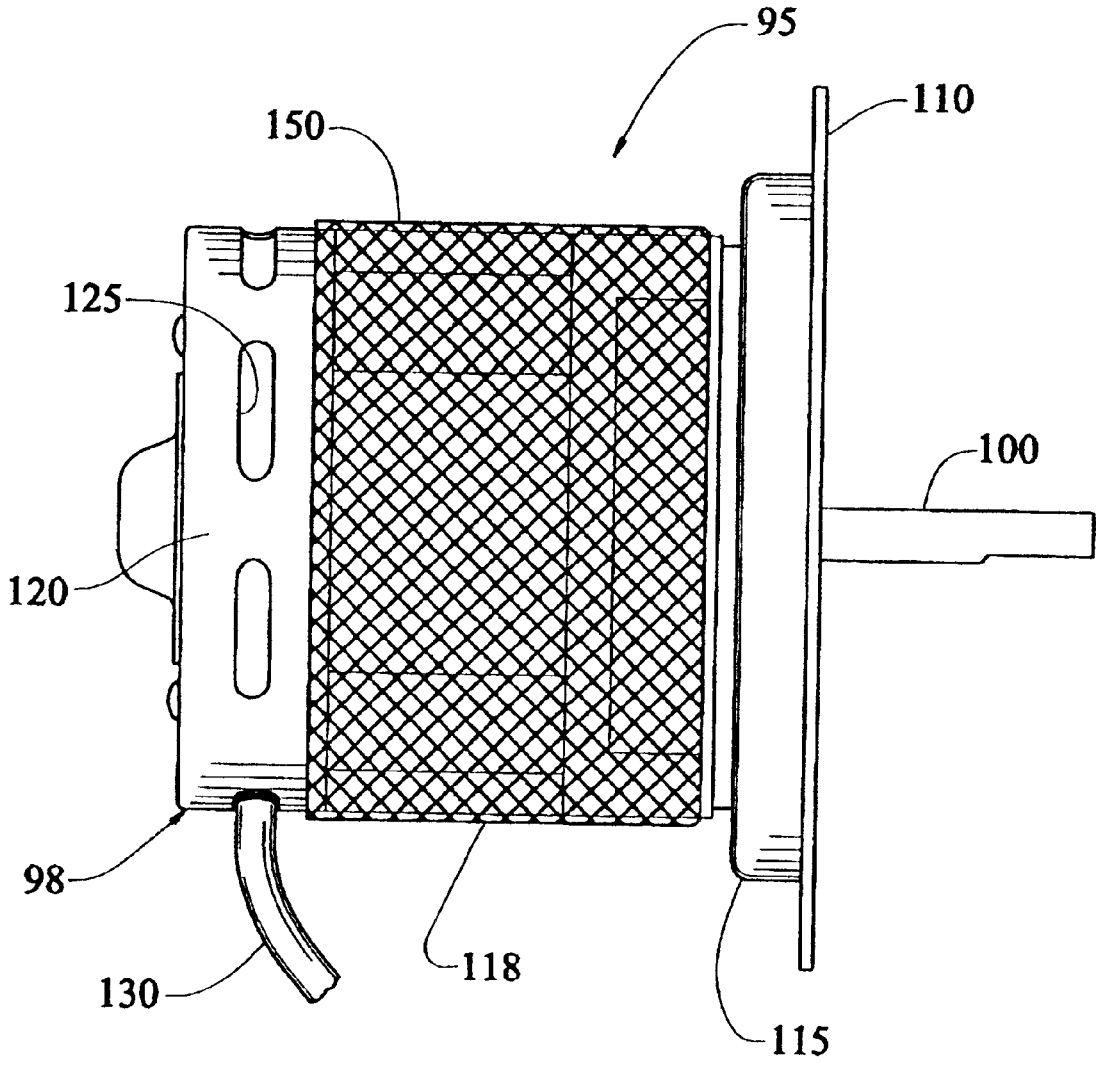
FIG. 2 is an enlarged view of the downdraft motor and protective heat shielding system of the invention.

In accordance with the present invention, downdraft grill 36 is part of an overall downdraft system 75 including a plenum 80, a blower or fan unit 90 for developing a venting air flow, a filter 91 positioned in plenum 80, between grill 36 and fan unit 90, and an exhaust conduit 92 leading to atmosphere. Fan unit 90 includes a fan housing 94 to which is attached a motor 95 having a motor housing 98 and an associated driveshaft 100 (see FIG. 2). More specifically, motor 95 includes a mounting plate 110, a first housing end portion 115, a central housing portion 118, and a second housing end portion 120. As shown, second housing end portion 120 is preferably provided with a plurality of circumferentially spaced venting slots 125. An electrical power cord 130 also extends into motor housing 98 at second housing end portion 120. In any event, it should be readily understood that fan unit 90 is utilized to generate an air flow designed to remove air laden cooking byproducts from a cooking zone of cooktop 15.

It is important in accordance with the present invention that motor 95 of fan unit 90 is mounted outside of plenum 80 for downdraft system 75. Due to this arrangement, motor 95 is substantially, directly exposed upon opening of doors 120 associated with cabinetry 12. However, in order to prevent direct contact with laminations (not labeled) of motor 95 which will become heated during use and are exposed at central housing portion 118, a shield 150, preferably in the form of a plastic sleeve, is provided to encircle housing 98 of motor 95. More specifically, in accordance with the most preferred form of the invention, plastic shield 150 constitutes a cylindrical mesh made from polypropylene, thereby having elastic properties which enable shield 150 to be slipped over second housing end portion 120 and onto central housing portion 118, either after or prior to attachment of electrical cord 130.

With this arrangement, motor 95 is not enclosed, thereby enhancing the cooling efficiency of motor 95, as well as its accessibility. Even though motor 95 is exposed upon opening of the cabinetry 12 below cooktop 15, the portions of motor 95 which can become excessively heated during operation of fan unit 90 are effectively covered by shield 150. Therefore, shield 150 will protect a consumer, maintenance personnel or the like from direct contact with central housing portion 118 which could become hot during operation of downdraft system 75 when the area below cooktop 15 is accessed.

Although described with reference to a preferred embodiment of the invention, it should be readily understood that various changes and/or modifications can be made to the invention without departing from the spirit thereof. For instance, as indicated above, it should be understood that the construction and configuration of cooktop 15 should not be considered limiting to the overall invention, but rather the overall heat shielding system of the invention can be employed in various venting arrangements where it is advantageous to avoid direct contact with a fan motor which exposed below kitchen countertop cabinetry. In general, the invention is only intended to be limited by the scope of the following claims.

I claim:

1. A downdraft cooking system comprising:

a countertop;

a cooktop including a plurality of heating element zones and an opening, said cooktop being arranged along the countertop;

cabinetry arranged below both the countertop and the cooktop;

a plenum disposed, at least in part, below the cooktop and behind portions of the cabinetry, said plenum being exposed to the opening in the cooktop; and a fan unit exposed to the plenum for developing a venting flow of air to withdrawn cooking byproducts through the opening and into the plenum from above the cooktop during a cooking operation, said fan unit including a motor having a housing directly exposed upon opening the cabinetry, said fan unit further including a heat shield disposed about and preventing direct contact with at least a portion of the housing, wherein the heat shield constitutes an open mesh sleeve.

2. A downdraft cooking system comprising:

a countertop;

a cooktop including a plurality of heating element zones and an opening, said cooktop being arranged along the countertop;

cabinetry arranged below both the countertop and the cooktop;

a plenum disposed, at least in part, below the cooktop and behind portions of the cabinetry, said plenum being exposed to the opening in the cooktop; and a fan unit exposed to the plenum for developing a venting flow of air to withdrawn cooking byproducts through the opening and into the plenum from above the cooktop during a cooking operation, said fan unit including a motor having a housing directly exposed upon opening the cabinetry, said fan unit further including a heat shield disposed about and preventing direct contact with at least a portion of the housing, wherein the motor includes first and second housing end portions and a central housing portion, said heat shield being provided about the central housing portion.

3. The downdraft cooking system according to claim 2, wherein the heat shield is positioned only about the central housing portion.

4. The downdraft cooking system according to claim 2, wherein the heat shield is cylindrical in shape.

5. The downdraft cooking system according to claim 4, wherein the heat shield constitutes an open mesh sleeve.

6. The downdraft cooking system according to claim 5, wherein the open mesh sleeve is formed from plastic.

7. The downdraft cooking system according to claim 6, wherein the plastic constitutes polypropylene.

8. The downdraft cooking system according to claim 2, wherein the motor is electrically powered and includes an electrical cord which extends through the second housing end portion, said heat shield being located between the electrical cord and the first housing end portion.

9. The downdraft cooking system according to claim 4, wherein the shield constitutes a cylindrical, plastic sleeve.

10. A cooking appliance comprising:

a cooktop having a plurality of heating element zones, said cooktop being adapted to be arranged along a countertop in a kitchen including lower cabinetry; and a venting system for removing cooking byproducts developed while cooking food on one or more of the plurality of heating element zones, said venting system including:

a plenum disposed below a level of the cooktop, said plenum being in fluid communication with an opening provided adjacent the plurality of heating element zones;

a fan unit exposed to the plenum for developing a venting flow of air to withdrawn cooking byproducts through the opening and into the plenum from above the cooktop during a cooking operation, said fan unit including a motor having a housing directly exposed upon opening the cabinetry; and a heat shield disposed about and preventing direct contact with at least a portion of the housing when accessing an area exposed upon opening of the cabinetry, wherein the motor includes first and second housing end portions and a central housing portion, said heat shield being provided about the central housing portion.

11. The cooking appliance according to claim 10, wherein the heat shield is positioned only about the central housing portion.

12. The cooking system according to claim 10, wherein the heat shield is cylindrical in shape.

13. The cooking system according to claim 12, wherein the heat shield constitutes an open mesh sleeve.

14. The cooking system according to claim 13, wherein the open mesh sleeve is formed from plastic.

15. The cooking system according to claim 14, wherein the plastic constitutes polypropylene.

16. The cooking system according to claim 10, wherein the motor is electrically powered and includes an electrical cord which extends through the second housing end portion, said heat shield being located between the electrical cord and the first housing end portion.

17. The cooking system according to claim 12, wherein the heat shield constitutes a cylindrical, plastic sleeve.

* * * * *